US006832670B2

(12) United States Patent
Wolters et al.

(10) Patent No.: US 6,832,670 B2
(45) Date of Patent: Dec. 21, 2004

(54) CONVERTIBLE TRAVEL CASE

(76) Inventors: Richard H. Wolters, 4767 Rockvalley Dr. NE., Grand Rapids, MI (US) 49525; Thomas R. Burt, 479 El Sueno Rd., Santa Barbara, CA (US) 93110

( * ) Notice: Subject to any disclaimer, the term of this patent is extended or adjusted under 35 U.S.C. 154(b) by 28 days.

(21) Appl. No.: 10/336,915

(22) Filed: Jan. 6, 2003

(65) Prior Publication Data

US 2004/0129520 A1 Jul. 8, 2004

(51) Int. Cl.[7] ..... A45C 5/14; A45C 13/38

(52) U.S. Cl. ..... 190/18 A; 190/15.1; 190/39; 190/115; 280/37; 280/47.371; 280/651; 280/655

(58) Field of Search ..... 190/1, 8, 15.1, 190/18 A, 39, 115; 280/37, 47.18, 47.27, 655, 43.371, 651

(56) References Cited

U.S. PATENT DOCUMENTS

| | | | | | |
|---|---|---|---|---|---|
| 1,716,611 | A | | 6/1929 | Wilson | |
| 2,977,130 | A | | 3/1961 | Jordan | |
| 3,702,016 | A | | 11/1972 | Keesee | |
| 3,751,058 | A | | 8/1973 | Larsen | |
| 3,865,392 | A | * | 2/1975 | Hartway | 280/35 |
| 4,261,447 | A | | 4/1981 | Arias et al. | |
| 4,340,132 | A | | 7/1982 | Cerna | |
| 4,792,025 | A | | 12/1988 | Thomas | |
| 4,974,871 | A | | 12/1990 | Mao | |
| 5,161,811 | A | | 11/1992 | Cheng | |
| 5,178,404 | A | | 1/1993 | Chen | |
| 5,203,815 | A | * | 4/1993 | Miller | 43/21.2 |
| 5,368,143 | A | | 11/1994 | Pond et al. | |
| 5,374,073 | A | | 12/1994 | Hung-Hsin | |
| 5,385,220 | A | | 1/1995 | Pond et al. | |
| 5,431,428 | A | | 7/1995 | Marchwiak et al. | |
| 5,447,217 | A | | 9/1995 | Chou | |
| 5,484,046 | A | | 1/1996 | Alper et al. | |
| 5,499,426 | A | | 3/1996 | Hsieh | |
| 5,500,981 | A | | 3/1996 | Ho | |
| 5,507,508 | A | | 4/1996 | Liang | |
| 5,513,873 | A | | 5/1996 | Chen | |
| 5,526,908 | A | | 6/1996 | Wang | |
| 5,639,109 | A | | 6/1997 | Liang | |
| 5,803,471 | A | | 9/1998 | DeMars et al. | |
| 5,806,142 | A | | 9/1998 | Wang | |
| 5,816,374 | A | | 10/1998 | Hsien | |
| 5,926,914 | A | | 7/1999 | Kuo | |
| 5,951,037 | A | | 9/1999 | Hsieh et al. | |
| 5,956,807 | A | | 9/1999 | Kuo | |
| 6,003,884 | A | | 12/1999 | Chang | |
| 6,012,729 | A | | 1/2000 | Lin | |
| 6,041,900 | A | | 3/2000 | Sadow et al. | |
| 6,061,871 | A | | 5/2000 | Wang | |
| 6,070,888 | A | | 6/2000 | Wang | |
| 6,082,757 | A | * | 7/2000 | Lin | 280/654 |
| 6,149,168 | A | | 11/2000 | Pauser et al. | |
| 6,193,033 | B1 | | 2/2001 | Sadow et al. | |
| 6,196,366 | B1 | | 3/2001 | Lin | |
| 6,237,734 | B1 | | 5/2001 | Chen | |
| 6,328,319 | B1 | * | 12/2001 | Stahler, Sr. | 280/47.18 |

* cited by examiner

*Primary Examiner*—Sue A. Weaver
(74) *Attorney, Agent, or Firm*—Price, Heneveld, Cooper, DeWitt & Litton, LLP

(57) ABSTRACT

A convertible travel case has a frame including an upright with a handle for grasping and a base with wheels for towing. A rigid case is mounted on the frame by a connector bracket having one portion pivotally connected with an upper part of the case and another portion slidably connected with the upright to permit the case to be shifted between a generally vertical storage position and a generally horizontal cart position. The frame and case have mating catch members at the bottom of the case. A releasable lock connects the connector bracket and the upright in a first raised position wherein the catch members are engaged to retain the case in the storage position, and a second lowered position wherein the catch members are disengaged and the lower end of the case is swung outwardly away from the frame with the connector bracket shifting downwardly along the upright to the cart position for supporting additional luggage on top of the case.

30 Claims, 4 Drawing Sheets

CONVERTIBLE TRAVEL CASE

BACKGROUND OF PRESENT INVENTION

The present invention relates to a portable travel case, and in particular, a portable travel case that may be converted into a cart.

Portable suitcases are used extensively throughout the world in part due to the increased popularity of travel. These cases are used to store a traveler's personal effects, while also providing the traveler with an easy means of transportation for these effects. Portable travel cases are generally well known and usually consist of a case member used for storage, a handle, and wheels so that the traveler may rollingly transport the portable case from one point to another.

Frequently however, these wheeled travel cases can be problematic because the traveler will place additional luggage on the case and then attempt to move the case from one destination to another. The additional luggage changes the center of gravity of the portable case, thereby creating an excessive burden on the traveler when transporting the case. Such excessive burdens are typically tolerated by able-bodied people, but are often intolerable for less than able-bodied people. In addition, because the portable case is not designed to carry the additional luggage, typically it is not well-secured and has a tendency to fall off. Further, because the portable travel case was not intended to transport the additional luggage, the traveler is faced with the difficulty of removing the extra baggage when the case needs to be collapsed for storage.

In an attempt to solve the problems mentioned above, portable suitcases have been developed that arc capable of being converted from a tow arrangement into a cart arrangement as illustrated and described by U.S. Pat. Nos. 5,385,220 and 5,368,143 to Pond et al. These cases however, have been problematic because they have not been designed to carry the heavy loads which are transported by today's travelers. In addition, today's travelers expect a portable case that is able to withstand a certain amount of misuse, and even abuse. They also expect their luggage to be easy to use, and ergonomically correct. Previously designed travel cases suffer from a general lack of durability. They are typically not capable of transporting heavy loads, are difficult to convert from a tow to a cart arrangement and back again, and lack the ergonomic features which today's travelers demand.

Therefore, what is needed is a portable suitcase that can be converted into a cart which is capable of carrying substantial additional loads. Further, a case is needed which easily converts from the cart and tow position, and still further easily collapses into a storage position. Additionally, a case which easily locks into, and unlocks from these positions, with a minimum amount of interaction thereby providing ergonomic operation, is desired.

Accordingly, an apparatus solving the aforementioned disadvantages and having the aforementioned advantages is desired.

SUMMARY OF THE INVENTION

One aspect of the present invention is a convertible travel case that includes a frame having an upright portion with a handle to facilitate grasping the travel case, and a base portion with at least one ground-engaging wheel to facilitate towing the travel case. The frame also includes a frame catch member which is used to secure the case member. The case includes a generally rigid case member having a hollow interior, which is shaped to retain travel articles. The case member further includes a first end portion and a second end portion, and a case catch member which releasably engages the frame catch member. A connector bracket has a first portion pivotally connected to the case member adjacent the first end portion, and a second portion slidably connected with the frame upright to permit the case member to be shifted between a generally vertical storage position and a generally horizontal cart position. The convertible travel case also includes a releasable lock detachably connecting the connector bracket with the upright in a first raised position wherein the frame and case catch members are engaged to retain the case member in a storage position for travel, and a second lowered position wherein the frame and case catch members are disengaged and the second end portion of the case member is swung outwardly away from the frame with the connector bracket shifting downwardly along the frame upright to the cart position for supporting additional luggage on top of the ease member.

The present invention provides a travel case that quickly and easily converts to a rugged handcart which is capable of carrying heavy loads. When the invention is utilized as a travel case, the case itself is designed to securely transport and protect the property located within it. Additionally, the travel case includes a telescopingly adjustable handle which when extended, is used to facilitate transportation of the case through the attached wheels. When the handle is in its retracted position, the travel case is then dimensioned to meet the maximum allowable size for air travel carry-on luggage. When the travel case is to be used as a handcart, the handle is fully extended and the case itself is moved from a horizontal position to a vertical position with the case itself acting as the platform of the hand cart. The handcart may then be loaded with additional bulky, heavy loads, allowing for simultaneous transportation of the case and the additional heavy loads.

Additionally, the handcart is designed to convert from the tow and cart position easily, and in a smooth fashion. This conversion is also carried out in a manner which is ergonomically correct, so as to avoid repetitive strain on the traveler. The cart is also designed to maintain a center of gravity that when loaded, will allow for the transportation of these heavy loads with relative ease. Therefore, a travel case has been invented which may easily convert to a handcart thereby allowing for additional articles to be transported with ease.

These and other features, advantages and objects of the present invention will further understood and appreciated by those skilled in the art by reference to the following specification, claims, and appended drawings.

DETAILED DESCRIPTION OF THE PREFERRED EMBODIMENT

Figure 1:
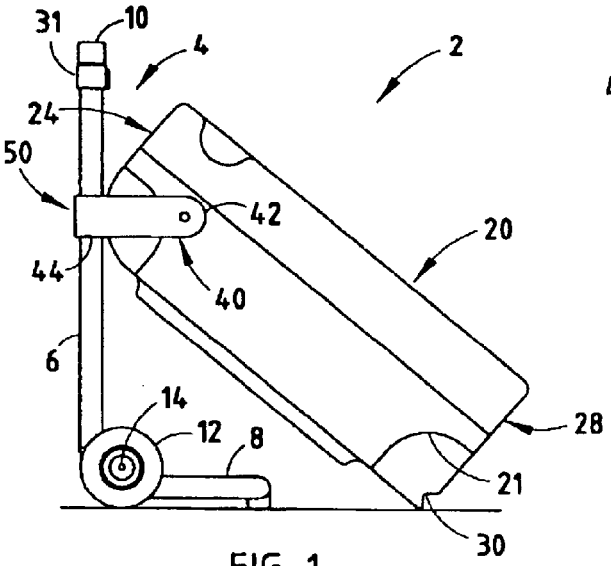
FIG. 1 is a side view of a travel case embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
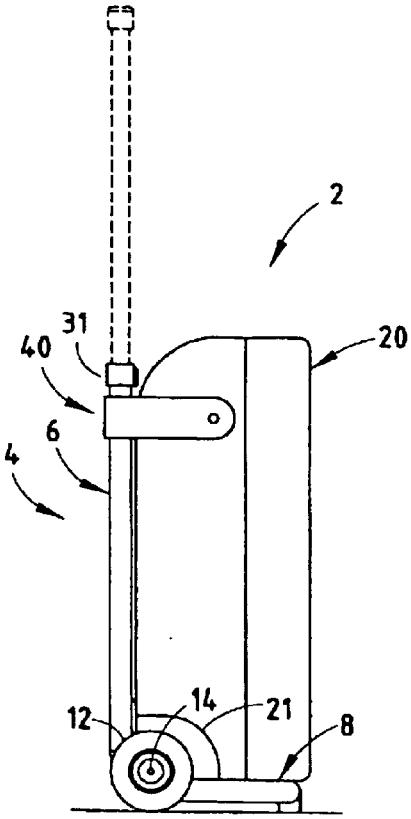
FIG. 3 is a side view of the travel case, shown in a generally vertical storage position, with a handle portion thereof fully retracted.
Figure 4:
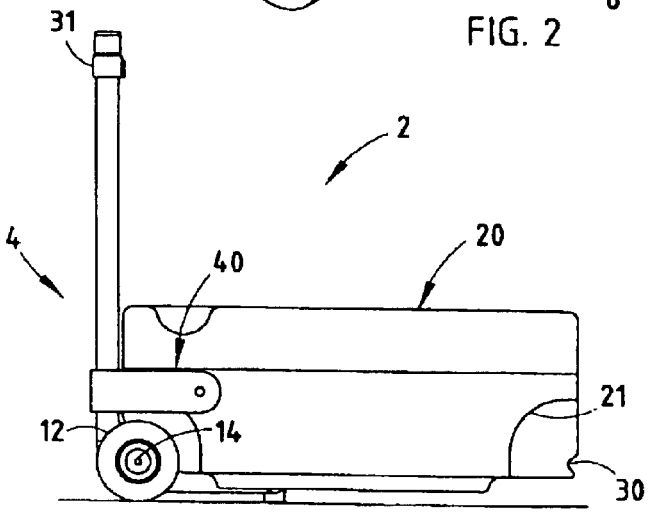
FIG. 4 is a side view of the travel case, shown in a generally horizontal cart position, with the handle fully retracted.
Figure 9:
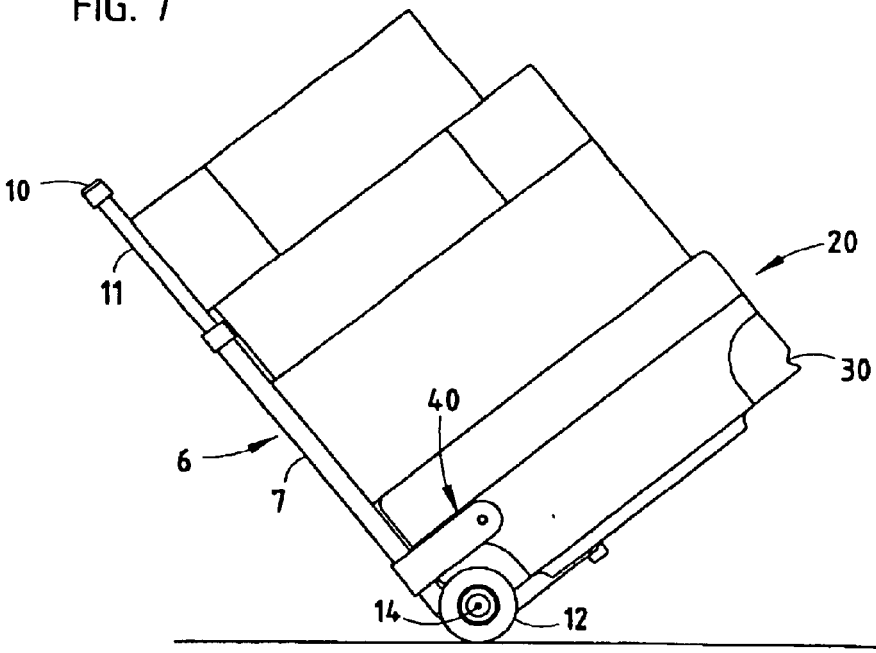
FIG. 9 is a side view of the travel case shown in the cart position, with additional luggage thereon.

The reference numeral 2 (FIG. 1) generally designates a travel case embodying the present invention. Travel case 2 includes a frame 4 having an upright portion 6 with a handle 10 for grasping, and a base portion 8 with ground engaging wheels 12 for towing. A rigid case member 20 is mounted on frame 4 by a connector bracket 40 having a first portion 42 pivotally connected with an end portion 24 of case 20 and a second portion 44 slidably connected with upright portion 6 to permit case member 20 to be shifted between a generally vertical storage position (FIG. 3), and a generally horizontal cart position (FIG. 4). Additionally, frame 4 has frame catch member 16, and case member 20 has mating catch member 30 located at an end portion 28 of case member 20. A releasable lock 50 connects connector bracket 40 and frame upright 6 in a raised position, wherein the mating catch members 16 and 30 are engaged to retain case member 20 in the vertical storage position (FIG. 3), and a lowered position wherein the matching catch members 16 and 30 are disengaged and end portion 28 of case member 20 is swung outwardly away from frame 4 with connector bracket 40 sliding downwardly along frame upright 6 to retain case member 20 in the horizontal cart position for supporting additional luggage on top of case member 20, as shown in FIG. 9.

Figure 2:
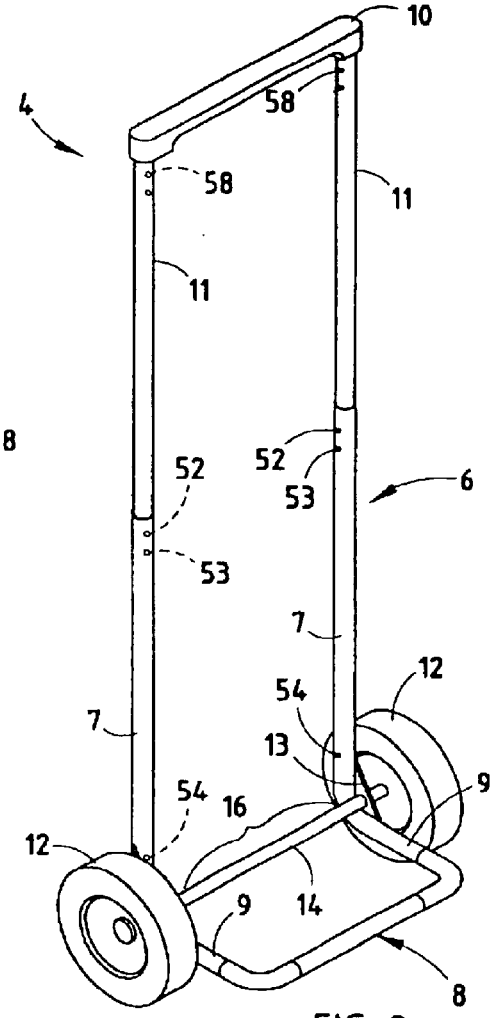
FIG. 2 is a side perspective view of a frame member portion of the travel case.

The illustrated frame is best shown in FIG. 2 and has a tubular construction which is generally L-shaped from a side elevational view. The frame includes base portion 8 which further includes a base tube 9 having a generally U-shaped top plan configuration, and frame upright portion 6 which further includes a pair of spaced-apart, mutually parallel upright tubes 7 upstanding from opposite sides of base tube 9. Frame 4 also includes a pair of extension tubes 11 telescopingly received in upright tubes 7, and a handle 10 is disposed on the upper ends of extension tubes 11. Telscopingly engaged extension tubes 11 allow handle 10 to be shifted between an extended tow position as illustrated in FIG. 3, and a retracted stow position as illustrated in FIG. 4.

Figure 5:
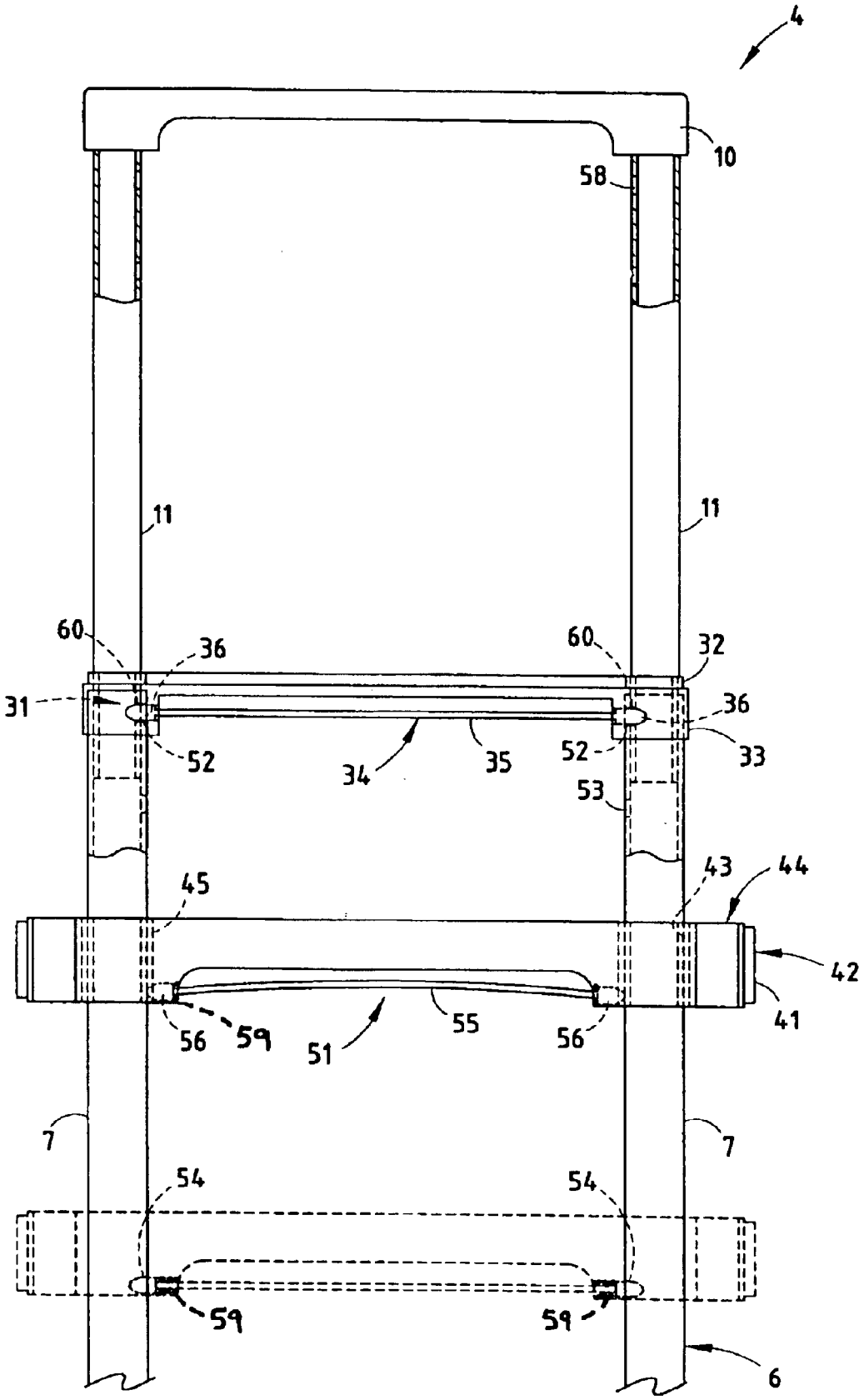
FIG. 5 is a fragmentary front view of an upper portion of the frame.

The upright portion 6 of frame 4 further includes a spanner 32, a spanner insert 33, and a releasable handle lock 31, including a lock actuator 34, operatively connected to a spring biased pair of pawls 36 (FIG. 5). Pawls 36 extend through a pair of laterally extending, coaxial apertures 52, located on upright portion 6, and are received in coaxial apertures 58 located on extension tubes 11, to positively retain handle 10 in the retracted stow position. When pawls 36 are disengaged from apertures 58, handle 10 may be moved to the extended tow position.

Figure 6:
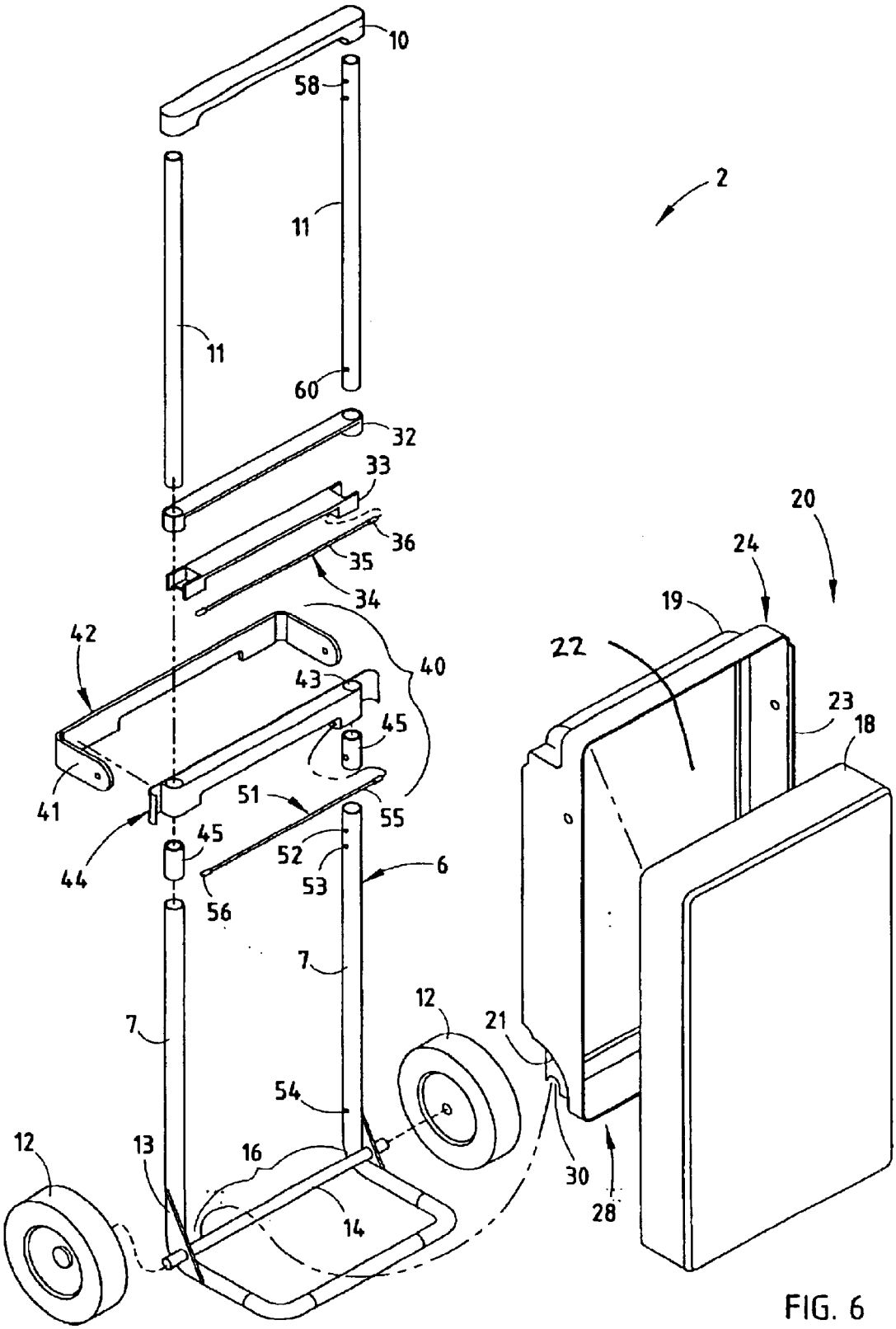
FIG. 6 is an exploded perspective view of the travel case.

As best illustrated in FIG. 6, spanner 32 is disposed adjacent the upper ends of tubes 7, and extends laterally between them to provide rigidity to upright portion 6 of frame 4. Disposed directly below spanner 32 is spanner insert 33, which houses lock actuator 34. Lock actuator 34 further includes a flexible line 35, and is configured to shift releasable lock 31 from a locked and unlocked position. Pawls 36 are disposed at each end of line 35 and are biased to extend through any orifice that is positioned on upright tubes 7 and into any orifice or indentation disposed on extension tubes 11, thereby locking extension tubes 11 in either an extended or retracted position. Pawls 36 may be retracted from locking apertures 58 and 60 by laterally flexing flexible line 35 from its normally straight position. Removing pawls 36 from their associated apertures releases lock 31 and allows extension tubes 11 to be telescopingly positioned.

In one embodiment of the present invention, pawls 56 are spring biased by springs 59, so as to move or shift laterally into a pair of coaxial apertures 52 and 58 disposed on the inside of upright tubes 7 and extension tubes 11 respectively, thereby locking extension tubes 11 and accordingly handle 10, in a retracted stow position as shown in FIG. 4. Lateral flexure of flexible line 35 disengages pawls 36 from apertures 58 in extension tubes 11 shifting releasable lock 31 into an unlocked position thereby allowing extension tubes 11 and handle 10 to be extended. When tubes 11 have been fully extended, as shown in FIG. 3, they may be locked into the tow position with pawls 36 engaging apertures 60. Additionally, pawls 36 may be, for example, bullet-shaped to facilitate close sliding reception into the apertures located on upright tubes 7, and extension tubes 11.

As illustrated in FIG. 6, at least one ground engaging wheel 12 is disposed on frame 4 to allow rotation of frame 4 in order to shift the center of gravity of case member 20 and any additional contents located thereon, while simultaneously allowing for the wheeled movement of travel case 2 over a floor surface. In one embodiment of the present invention, a pair of wheels 12 are mounted on opposite ends of axle 14, with axle 14 being disposed horizontally and extending between a pair of corner brackets 13. Corner brackets 13 are rigidly disposed across upright portion 6 and base tube 9 to provide further rigidity to frame 4. Further, the central portion of axle 14 defines frame catch member 16, and supports case catch member 30 when case member 20 is in a vertical storage position, as discussed below.

Frame 4 is preferably made of a rigid material such as, for example, aluminum, steel, or any other structurally rigid material suitable for this purpose. In one embodiment of the present invention, base portion 8 and upright portion 6 of frame 4 are formed from a single length of tubing.

As best illustrated in FIG. 6, case member 20 includes case top 18 and case bottom 19 which are hingedly interconnected by hinge 23 to allow easy access to the hollow interior portion 22 of case member 20. Case bottom 19 includes a pair of recessed wheel wells 21 disposed on opposite sides of case bottom 19 to receive therein ground-engaging wheels 12. Case catch member 30 is defined by a downwardly opening channel in case bottom 19 disposed opposite recessed wheel openings 21, and is shaped to closely receive frame catch member 16, which in the illustrated example, is the center portion of axle 14. In one working embodiment of the present invention, case member 20 is constructed of a rigid molded plastic, with one of the case top 18 or case bottom 19 having a locking mechanism, for example a keyed lock, which may latch to the other of case top 18 or case bottom 19 in a lockable fashion to retain the articles contained within the case in a secure fashion. Additionally, case member 20 may be dimensioned to be received within the overhead compartment of a passenger aircraft when case member 20 is in the vertical storage position and extension tubes 11 are in the stow position.

Case member 20 further includes an end portion 24 and 28. When case 20 is in a vertical position, end portion 24 is located directly above and parallel to end portion 28. This vertical orientation is maintained on frame 4 by frame catch member 16 being closely disposed within ease catch member 30.

Also illustrated in FIG. 6 is connector bracket 40 which includes a portion 42 and 44. Portion 42 has a pair of yoke portions 41 which pivotally connect case member 20 with bracket 40. Portion 44 has a slider portion 43 with a pair of slider sleeves 45 closely received over upright tubes 7. Slider sleeves 45 allow bracket 40 to slidably connect with upright tubes 7 allowing case member 20 to be moved from a vertical storage position to a horizontal cart position and vica-versa.

As illustrated in FIG. 5, releasable lock 50 locks and unlocks bracket 40 to frame upright tubes 7 to permit shifting case member 20 between the storage position (FIG. 3), and the cart position (FIG. 4). Case lock 50 is disposed within portion 44 of bracket 40, and further includes an actuator 51. Like handle actuator 34 described above, case actuator 51 includes a flexible line 55 and a pair of spring-biased pawls 56 at opposite ends of line 55 which normally alternately engage a pair of coaxial apertures 53 or 54 located on upright portion 6 to lock bracket 40 in either the storage or cart position. The unlocking of bracket 40 is accomplished by laterally flexing flexible line 55, which disengages spring-biased pawls 56 from coaxial aperture 53 when case 20 is in the storage position, or coaxial aperture 54 when case 20 is in the cart position, thereby unlocking bracket 40 and allowing it to slide on frame upright 6 to its alternate position. Further, flexible line 55 is configured for foot actuation when bracket 40 is in the cart position. This facilitates releasing case lock 50, allowing case 20 to be shifted from the cart position to the storage position, without requiring the traveler to bend in order to release the lock. Additionally, Pawls 56 may be, for example, bullet-shaped to facilitate close sliding reception into coaxial apertures 53 and 54, in upright tubes 7.

Figure 7:
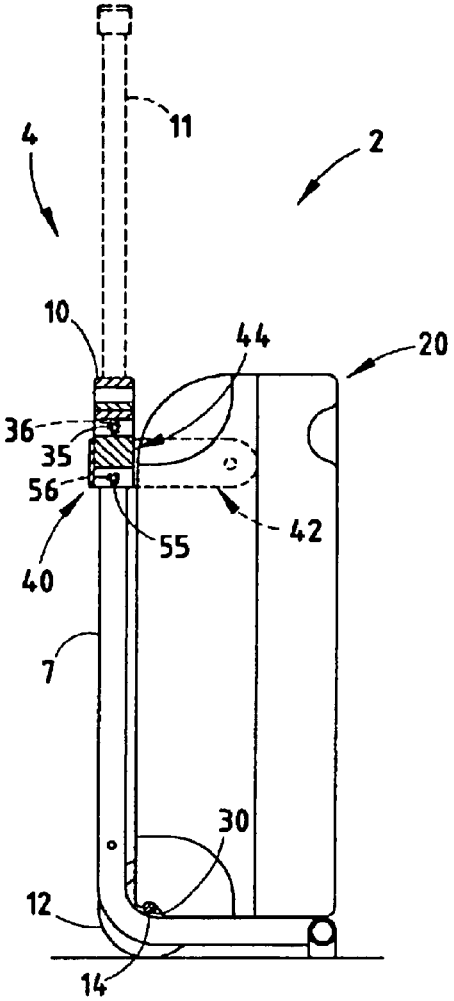
FIG. 7 is a vertical sectional view of the travel case, shown in the storage position.
Figure 8:
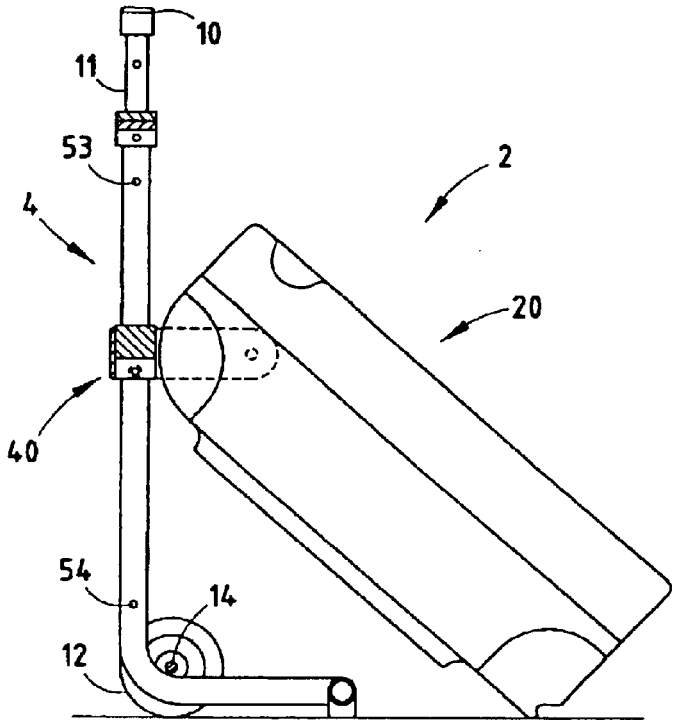
FIG. 8 is a vertical sectional view of (the travel case, shown in an intermediate position.

In one working embodiment of the present invention, travel case 2 may be converted from a stow position wherein case member 20 is in the storage position and extension tubes 11 are in a stow position (FIG. 7), to a tow position in the following manner. Releasable handle lock 31 is actuated by laterally flexing flexible line 35 disposed underneath handle 10, thereby retracting spring-biased pawls 36 from apertures 58, to release extension tubes 11 from their stow position. Extension tubes 11 are then moved to their extended tow position, and locked in place by spring biased pawls 36 being closely received in apertures 60 of extension tube 11, whereby travel case 2 may be rollingly moved from one location to another. Travel case 2 may be converted into a cart configuration by first actuating flexible line 55 of lock 50, thereby disengaging spring-biased pawls 56 from apertures 53 to release bracket 40 from its vertical storage position. Simultaneously, the end portion 22 of case 20 is lifted slightly to disengage case catch member 30 (FIG. 7). As illustrated in FIG. 8, case 20 is then rotated outwardly and downwardly, pivoting on portion 42 of bracket 40, while portion 44 of bracket 40 is slid downwardly along upright tubes 7 to position bracket 40 in its lowered position, wherein further case 20 is in its horizontal cart position (FIG. 9). Spring-biased pawls 56 will then automatically engage apertures 54. With case member 20 locked in the horizontal cart position, other packages may be placed on top of case 20 and travel case 2 now functions as a cart.

As illustrated in FIG. 9 cart operation is as follows. When case 20 is in the horizontal cart position, extra items are positioned on case top 18 and against frame upright portion 6. This allows the extra items to be securely positioned on travel case 2 by resting against both, frame upright portion 6, and case top 18. It also eliminates the need for additional fastening means such as tie downs. When travel case 2 is to be moved, the traveler will rotate upright frame portion downwardly, thereby rotating case portion 28 upwardly thereby transferring the weight of the load to wheels 12. This allows the traveler to rotate the center of gravity of the loaded travel case to a position that is comfortable. By positioning the center of gravity of the load directly over wheels 12, the traveler may rollingly move the heavily loaded cart to its destination with a minimum amount of effort. When the traveler arrives at the destination, because the packages were not tied down, the cart may be easily and quickly unloaded.

Finally, the case is converted from the cart position to the stow position in the following manner. Releasable lock 50 is disengaged by laterally flexing flexible line 55. This may be accomplished by positioning the traveler's palm on portion 44 of connector bracket 40 and laterally flexing flexible line 55 with his or her fingers. However, in one embodiment of the present invention portion 44 and flexible line 55 are designed to be laterally flexed using the traveler's foot or shoe. This is accomplished by flexing flexible line 55 using the toe of the traveler's shoe thereby releasing actuator 51 and unlocking lock 50. This allows the case to be converted with less bending of the travelers back and therefore less strain on the traveler. Case 20 is then shifted to its vertical storage position by simultaneously sliding connector bracket 40 along frame upright tubes 7 and rotating end portion 28 of case 20 inwardly and upwardly. Case catch member 30 is then disposed over and closely received with frame catch member 16 while spring biased pawls 56 automatically engage apertures 53 thereby locking case 20 in its storage position. Releasable lock 31 is then actuated as described above allowing extension tubes 111 to be telescopingly retracted within upright tubes 7 and when fully retracted spring biased pawls 36 automatically engage apertures 52 to lock extension tubes 11 in their stow position.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A convertible travel case, comprising:

a frame having an upright portion thereof with a handle to facilitate grasping said travel case, and a base portion thereof with at least one ground-engaging wheel to facilitate towing said travel case, and a frame catch member;

a generally rigid case member having a hollow interior portion shaped to retain travel articles therein, a first end portion and a second end portion with a case catch member which releasably engages said frame catch member;

a connector bracket means having a first portion thereof pivotally connected with said case member adjacent said first end portion thereof, and a second portion thereof slidably connected with said upright portion of said frame for permitting said case member to be shifted between a generally vertical storage position and a generally horizontal cart position; and a releasable lock detachably connecting said connector bracket means with said upright portion of said frame in a first raised position wherein said frame and case catch members are engaged to retain said case member in said storage position for travel, and a second lowered position wherein said frame and case catch members are disengaged and said second end portion of said case member is swung outwardly away from said frame with said connector bracket means shifting downwardly along said upright portion of said frame to said cart position for supporting additional luggage on top of said case member.

2. A convertible travel case as set forth in claim 1, wherein:

said lock includes an actuator supported on said upright portion of said frame and configured to shift said lock between locked and unlocked positions.

3. A convertible travel case as set forth in claim 2, wherein:

said actuator includes a flexible line with spring biased pawls at opposite ends thereof which normally engage said upright portion of said frame to positively retain said lock in said locked position, whereby flexure of said line disengages said pawls from said upright portion of said frame to shift said lock into said unlocked position and permit shifting said case member between said storage position and said cart position.

4. A convertible travel case as set forth in claim 3, wherein:

said travel case is dimensioned to permit carry-on use for commercial aircraft travel.

5. A convertible travel case as set forth in claim 4, wherein:

said frame has a tubular construction with a generally L-shaped side elevational configuration.

6. A convertible travel case as set forth in claim 5, wherein:

said frame base portion comprises a base tube having a generally U-shaped top plan configuration; and said upright portion of said frame comprises a pair of spaced apart, mutually parallel upright tubes upstanding from opposite sides of said base tube.

7. A convertible travel case as set forth in claim 6, wherein:

said frame includes a pair of extension tubes telescopingly received in said upright tubes which mount said handle on upper ends thereof and permit said handle to be shifted between an extended tow position and a retracted stow position.

8. A convertible travel case as set forth in claim 7, wherein:

said connector bracket means includes a yoke portion thereof pivotally connecting said case member with said frame, and a slider portion thereof with a pair of slider sleeves closely received over said upright tubes to shift the first end portion of said case member between said storage position and said cart position.

9. A convertible travel case as set forth in claim 8, wherein:

said case member includes a case bottom and a case top which are hingedly interconnected for easy access to said interior portion of said case member.

10. A convertible travel case as set forth in claim 9, wherein:

said frame includes a horizontally extending axle disposed adjacent said base portion thereof with a pair of ground-engaging wheels rotatably mounted on opposite ends of said axle.

11. A convertible travel case as set forth in claim 10, wherein:

said frame catch member is defined by an exposed central portion of said axle; and said case catch member is defined by a downwardly opening channel in said case bottom which is shaped to closely receive therein said exposed central portion of said axle.

12. A convertible travel case as set forth in claim 11, wherein:

said case bottom includes a pair of recessed wheel wells on opposite sides thereof in which said ground-engaging wheels are received.

13. A convertible travel case as set forth in claim 12, wherein:

said handle includes a releasable lock to selectively retain the same in said tow position and said stow position.

14. A convertible travel case as set forth in claim 13, wherein:

said upright tubes include first and second pairs of laterally extending, coaxial apertures in which said pawls are closely received to positively retain said case member in said storage position and said cart position.

15. A convertible travel case as set forth in claim 14, wherein:

said frame base portion and said upright portion of said frame are formed from a single length of tubing.

16. A convertible travel case as set forth in claim 15, including:

a spanner mounted adjacent the upper ends of said upright tubes and extending laterally therebetween to provide rigidity to said upright portion of said frame.

17. A convertible travel case as set forth in claim 16, wherein:

said actuator includes a spanner insert retaining said flexible line and said pawls.

18. A convertible travel case as set forth in claim 17, wherein:

said pawls are bullet-shaped to facilitate close sliding reception into said first and second pairs of apertures in said upright tubes.

19. A convertible travel case as set forth in claim 18, wherein:

said flexible line is configured for foot actuation when said case member is in said cart position to facilitate releasing said lock and shifting said case member to said storage position.

20. A convertible travel case as set forth in claim 19, wherein:

said case member has a molded plastic construction.

21. A convertible travel case as set forth in claim 1, wherein:

said travel case is dimensioned to permit carry-on use for commercial aircraft travel.

22. A convertible travel case as set forth in claim 1, wherein:

said frame has a tubular construction with a generally L-shaped side elevational configuration.

23. A convertible travel case as set forth in claim 1, wherein:

said frame base portion comprises a base tube having a generally U-shaped top plan configuration, and upright portion of said frame comprises a pair of spaced apart, mutually parallel upright tubes upstanding from opposite sides of said base tubes.

24. A convertible travel case as set forth in claim 1, wherein:

said frame includes a pair of extension tubes telescopingly received in said upright portion of said frame which mount said handle on upper ends thereof and permit said handle to be shifted between an extended tow position and a retracted stow position.

25. A convertible travel case as set forth in claim 1, wherein:

said case member includes a case bottom and a case top which are hingedly interconnected for easy access to said interior portion of said case member.

26. A convertible travel case as set forth in claim 1, wherein:

said frame includes a horizontally extending axle disposed adjacent said base portion thereof with a pair of ground-engaging wheels rotatably mounted on opposite ends of said axle.

27. A convertible travel case as set forth in claim 26, wherein:

said frame catch member is defined by an exposed central portion of said axle; and said case catch member is defined by a downwardly opening channel in a bottom portion of said case which is shaped to closely receive therein said exposed central portion of said axle.

28. A convertible travel case as set forth in claim 1, wherein:

said lock is configured for foot actuation when said case member is in said cart position to facilitate releasing said lock and shifting said case member to said storage position.

29. A convertible travel case as set forth in claim 1, wherein:

said case member has a molded plastic construction.

30. A convertible travel case, comprising:

a frame having an upright portion thereof with a handle to facilitate grasping said travel case, and a base portion thereof with at least one ground-engaging wheel to facilitate towing said travel case, and a frame catch member;

a generally rigid case member having a hollow interior portion shaped to retain travel articles therein, a first end portion and a second end portion with a case catch member which releasably engages said frame catch member;

a connector bracket means for permitting said case member to be shifted between a generally vertical storage position and a generally horizontal cart position; and a releasable lock detachably connecting said connector bracket means with said upright portion of said frame in a first raised position wherein said frame and case catch members are engaged to retain said case member in said storage position for travel, and a second lowered position wherein said frame and case catch members are disengaged and said second end portion of said case member is swung outwardly away from said frame with said connector bracket means shifting downwardly along said upright portion of said frame to said cart position for supporting additional luggage on top of said case member;

and, wherein said connector bracket means includes a yoke portion thereof pivotally connecting said case member with said frame, and a slider portion closely received over said upright portion of said frame upright to shift the first end portion of said case member between said storage position and said cart position.

* * * * *